United States Patent [19]

Follick

[11] 4,183,317

[45] Jan. 15, 1980

[54] VERSATILE ALL PURPOSE BARRICADE STRUCTURES

[76] Inventor: George E. Follick, P.O. Box 15207, Wyoming, Ohio 45215

[21] Appl. No.: 841,294

[22] Filed: Oct. 12, 1977

[51] Int. Cl.[2] ..... E01F 9/10; E01F 13/00

[52] U.S. Cl. ..... 116/63 P; 182/185; 256/64; 248/439

[58] Field of Search ..... 116/63 P, 63 R; 182/155, 185; 256/64, 13.1; 40/125 H; 248/439, 168, 176, 169, 170, 408, 188.91; 403/186

[56] References Cited

U.S. PATENT DOCUMENTS

| | | | |
|---|---|---|---|
| 390,103 | 9/1888 | Wallace et al. | 182/155 |
| 809,729 | 1/1906 | Normand | 182/155 |
| 1,732,081 | 10/1929 | Clement | 248/408 X |
| 2,204,557 | 6/1940 | Ahles | 256/13.1 |
| 2,249,685 | 7/1941 | Dearing | 256/64 |
| 2,485,178 | 10/1949 | Weinkauf | 182/155 X |
| 2,705,174 | 3/1955 | Squire | 182/185 X |
| 2,722,970 | 11/1955 | Stechmann | 248/408 X |
| 2,806,670 | 9/1957 | Straster | 116/63 P X |
| 2,859,066 | 11/1958 | Franklin | 182/155 X |
| 2,925,140 | 2/1960 | Thielepape | 182/155 |
| 2,930,589 | 3/1960 | Blaskiewicz, Jr. | 256/64 |
| 3,110,360 | 11/1963 | Hearn | 182/155 |
| 3,213,557 | 10/1965 | Clement | 116/63 P X |
| 3,476,362 | 11/1969 | Thompson | 256/13.1 |
| 3,675,613 | 7/1972 | Sayles | 116/63 P |
| 4,065,104 | 12/1977 | Pass | 256/13.1 |

FOREIGN PATENT DOCUMENTS

| | | | |
|---|---|---|---|
| 1117283 | 6/1968 | United Kingdom | 40/606 |

*Primary Examiner*—Daniel M. Yasich

*Attorney, Agent, or Firm*—Frost & Jacobs

[57] ABSTRACT

The versatile all purpose barricade structures of this invention include a portable road sign unit which utilizes a triangular brace member or support bracket and collapsible legs with ring means for locking them in place. Hollow legs are utilized in connection with plugs which enable the legs to be repaired on the job when necessary. The legs may also be internally loaded so that the use of sand bags and the like is unnecessary. The structures include a tape unit which may be quickly and conveniently put in operating position. The structures also include a slidable barricade panel which may be used in connection with separate leg units. The support bracket and associated leg units may be a separate item which slidably receives a barricade panel of any length, or the bracket and legs may be permanently affixed to a barricade panel. The barricade panel may also be stood on end to serve as an upright, elongated light or flag holder. The barricade structures also include means for affixing flags and lights thereto. Pairs of the barricades may be used at right angles to one another to support large signs. Pairs of the barricades may also be used end to end in order to span large openings. The structures may be readily collapsed in order that they may be handled more easily. These versatile all purpose barricade structures, when damaged, may be quickly repaired with minimum expense and loss of time.

31 Claims, 20 Drawing Figures

VERSATILE ALL PURPOSE BARRICADE STRUCTURES

BACKGROUND OF THE INVENTION

1. Field of the Invention

The versatile all purpose barricade structures of this invention are particularly suited for use by public utilities such as gas and electric and telephone companies and the like which often have considerable road work to do. The structures are very suitable for highway maintenance and repair. The structures may be used for warning devices of various kinds for both human and vehicular traffic.

2. Description of the Prior Art

A fairly extensive patentability search was conducted, mostly with respect to the United States patent art, and a number of references were developed. No assertion is made that the most pertinent art was developed although that was the purpose of the search. The following U.S. Pat. Nos. appeared to be of most interest: GOODMAN 1,863,442; GOLDBERG 2,059,996; BEALL 2,564,145; CARPENTER 2,995,847; WHITMAN 3,256,629; TRIGILIO 3,292,569; ALLISON 3,557,479; DALUM 3,591,116; SAYLES 3,675,613; DICKE 3,677,511; SWEET 3,740,880; ROWLAND 3,792,678; and ROSS 3,847,335. Attention is also called to Italian Pat. No. 312,607 (1933).

The foregoing patents relate to various portable safety signals, portable units having both visual and electric signals such as for traffic and the like, road sign standards, sign structures, warning devices for disabled highway vehicles, portable road sign units, collapsible sign stands and signal assemblies, portable folding warning sign standards, and foldable barricades and signs.

The known prior art devices and barricade means are quite susceptible to damage such as is caused by storms and high winds as well as by being struck by various kinds of vehicles. Many of these structures must have auxiliary supports in order to keep them properly in place and this can be both time consuming and expensive. Many of the stands have legs which provide only one position when in use. Many of the units are not nearly so portable as is desired.

SUMMARY OF THE INVENTION

The versatile all purpose barricade structures of this invention include a support bracket which may be welded or otherwise permanently affixed to a panel receiving member, or it may be bolted to such a member, or it may be fixed in either of these ways directly to the barricade panel. The bracket provides much needed strength to the legs when in their upright position. The arrangement of the legs is such that when damaged they may be readily replaced in the field simply by cutting the old leg away from a permanent plug and then simply sliping another leg in place about such plug and locking it thereto as may be achieved by causing a crimp therein by cutting through the new leg and into the old plug. The ground engaging ends of the tubular leg members may be burred so that steel or lead weights may be loaded into the legs to lend more stability thereto and in many cases do away with the need to shore them up with sandbags and the like. Ring lock means are provided which may easily be moved from a lock position to an unlocked position simply by turning the barricade structure upside down. The support bracket and associated leg holding structure may include means up which a warning tape may be locked in position quite readily. By using a pair of the support brackets and associated leg structures, each bracket having a barricade panel receiving means, panels of any desired length may be employed. Additionally means are provided for extending the legs to a spread position whereby to increase the area over which the warning barricade may extend.

In one modification of the invention the triangular support bracket is welded to leg receiving channels, the upper ends of which channels are in turn welded to a barricade panel receiving bracket member. A light support bracket is affixed to one side of the panel receiving bracket and a shelf for the light affixed to the opposite side. A flag receiving receptacle may also be affixed to the panel receiving bracket. A spring biased means for affixing a flexible warning tape to the structure is also affixed to the panel receiving bracket. The leg structure includes a solid plug and a hollow leg slipped thereover, the hollow leg and plug being bolted to the leg receiving brackets and spring biased therein as well. The triangular support bracket includes a cross bar for added strength and to serve as a stop for the legs when in their spread position. Locking rings are slidble about the leg receiving channel members and are of sufficient internal diameter to accept the leg and plug. In a modification of the invention the panel receiving brackets may be eliminated and the triangular support bracket and associated leg channels fixed directly to a selected barricade panel. In a further modification of the invention, the triangular support bracket is provided with means by which it may be bolted to either a panel receiving bracket or to the panel itself; such modified support bracket is also provided with means by which the leg receiving channels may be bolted thereto.

The barricade structures of this invention, particularly the triangular brace member or support bracket, enable pairs of barricade standards to be employed in novel ways. By using a pair of standards placed at right angles to one another, signs of considerable size may be locked in place and secured against being toppled over by wind storms and the like. In an arrangement wherein a pair of the barricade standards are placed end to end, the support bracket makes it quite simple to bind the two standards together so that an open area of considerable space may readily be spanned.

BRIEF DESCRIPTION OF THE DRAWINGS

FIGS. 16A, 16B, 16C and 16D are a series of enlarged, fragmentary elevations showing the repair sequence and leg structure utilized as a part of this invention.

FIG. 17 is an elevation depicting a pair of barricade standards positioned at right angles to one another so as to receive and hold a large sign securely against high winds and the like.

FIG. 18 is an elevation depicting a pair of barricade standards according to this invention in abutting end to end relationship and secured by binding applied to adjacent pairs of support brackets.

FIG. 19 is a perspective view of a modified, preferred support bracket for use with suitable leg structures and panel means or panel receiving means.

DESCRIPTION OF THE PREFERRED EMBODIMENTS

Figure 1:
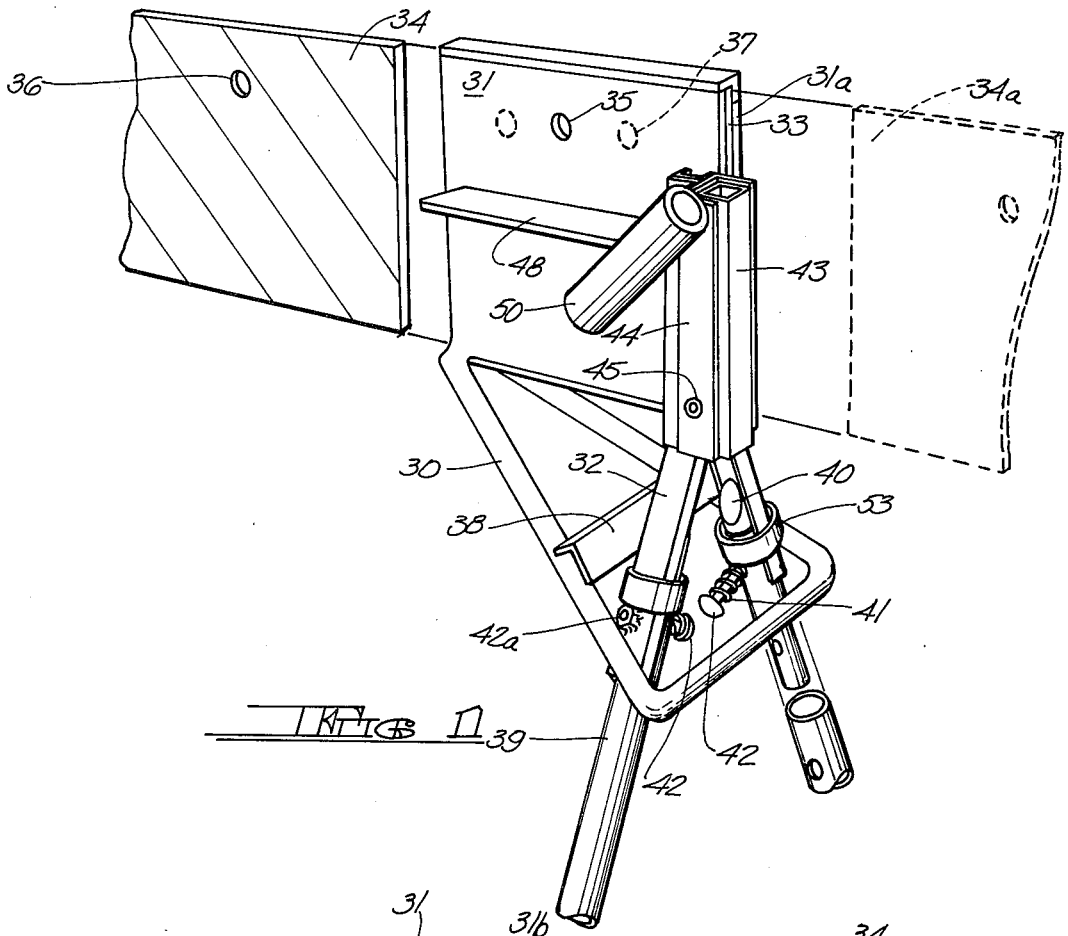
FIG. 1 is a fragmentary perspective view, partly in phantom, showing one modification of the invention.
Figure 2:
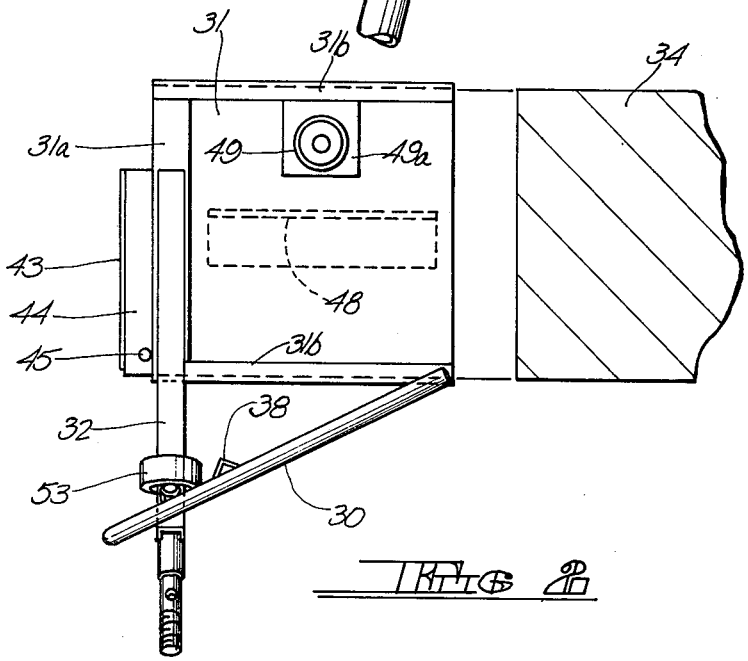
FIG. 2 is an exploded, partial rear elevation taken from the backside of the arrangement shown in FIG. 1.
Figure 3A:
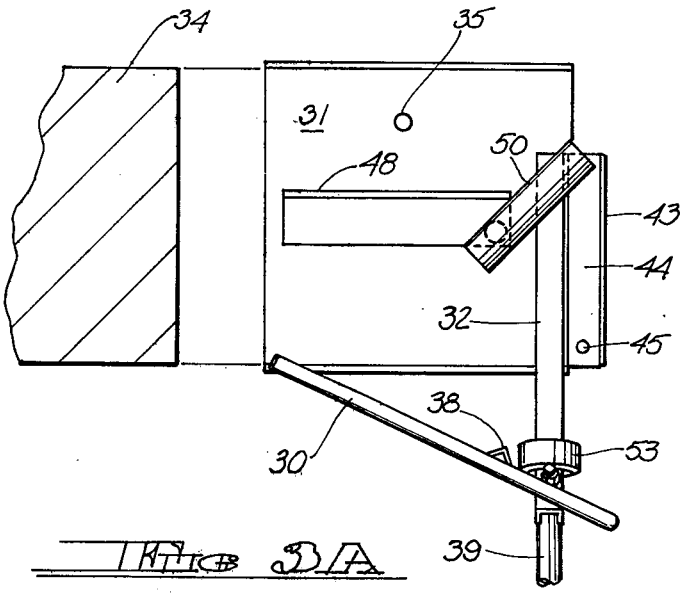
FIG. 3A is an exploded, partial front elevation taken from the front side of FIG. 1.
Figure 4:
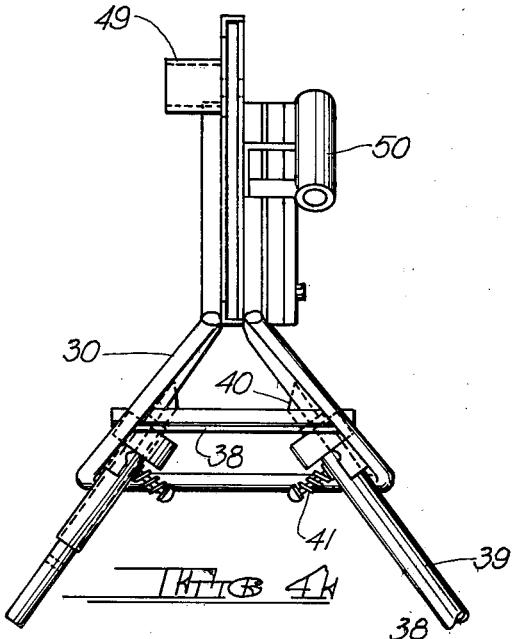
FIG. 4 is an end view taken from the left side of FIG. 3A.
Figure 5:
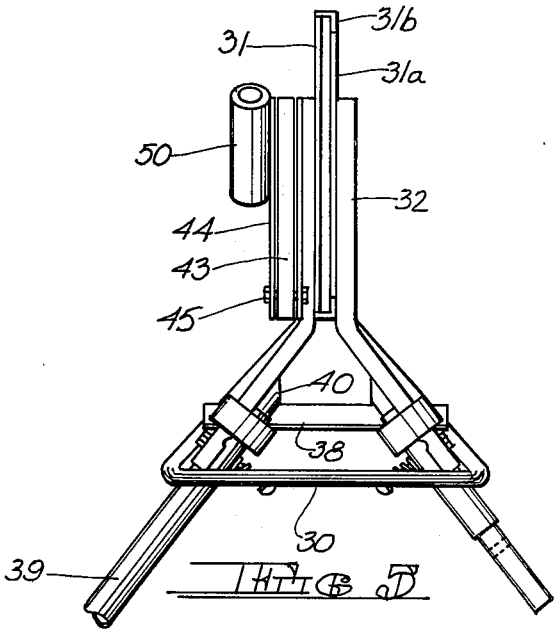
FIG. 5 is an end view taken from the right side of FIG. 3A.
Figure 6:
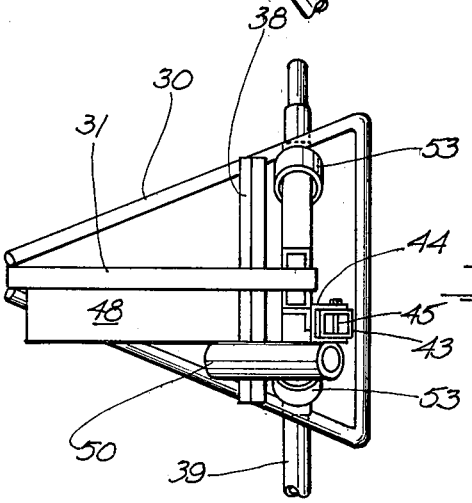
FIG. 6 is a top view taken from above the structure shown in FIG. 3A.

In the modification of FIGS. 1 through 6 the triangular brace member or support bracket 30 is shown as being welded to a barricade panel receiving member 31 and to a pair of leg receiving channel members 32. The panel receiving member 31 has flange means to define a channel 33 adapted to receive a barricade panel 34 therewithin. The upper ends of the leg receiving channel members 32 are also affixed, as by welding and the like, to either side of the member 31. The member 31 and barricade panel 34 are provided with orifices 35 and 36 respectively to receive a bolt and the like for securing the panel 34 within the member 31. As is best seen in FIG. 1 additional orifices 37 may be provided in the member 31 so that, for example, a panel 34*a* shown in phantom in the figure, may be received at one side of the member 31 and the panel 34 at the other side thereof. The support bracket 30 also includes a more or less centrally located bar 38 affixed thereto.

The legs 39 are hollow and preferably provided with a solid steel plug 40 and the like at their upper ends. Each leg and plug is adapted to be received in the channel member 32 and such leg and plug are secured to the channel member by means of a bolt and nut which passes through these members 39, 40 and 32. A heavy spring 41 is located between the head of the bolt 42 and the outside of the tubular leg 39. The nut which secures the bolt is indicated at 42*a*. By this arrangement the spring 41 normally maintains the leg and plug 39, 40 within the confines of the respective channel member 32. When, however, it is desired to move the leg to a spread position, or to fold the leg, such actions may be accomplished by over powering the spring 41.

Figure 15:
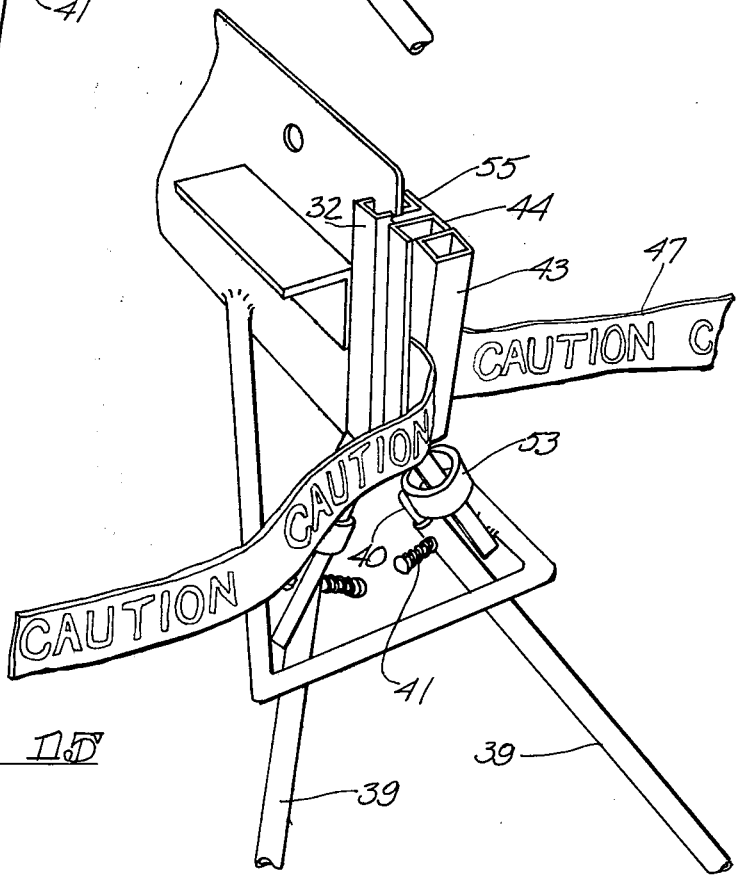
FIG. 15 is a fragmentary perspective view like that of FIG. 14 and showing a flexible warning strip or ribbon securely held in place.
Figure 10B:
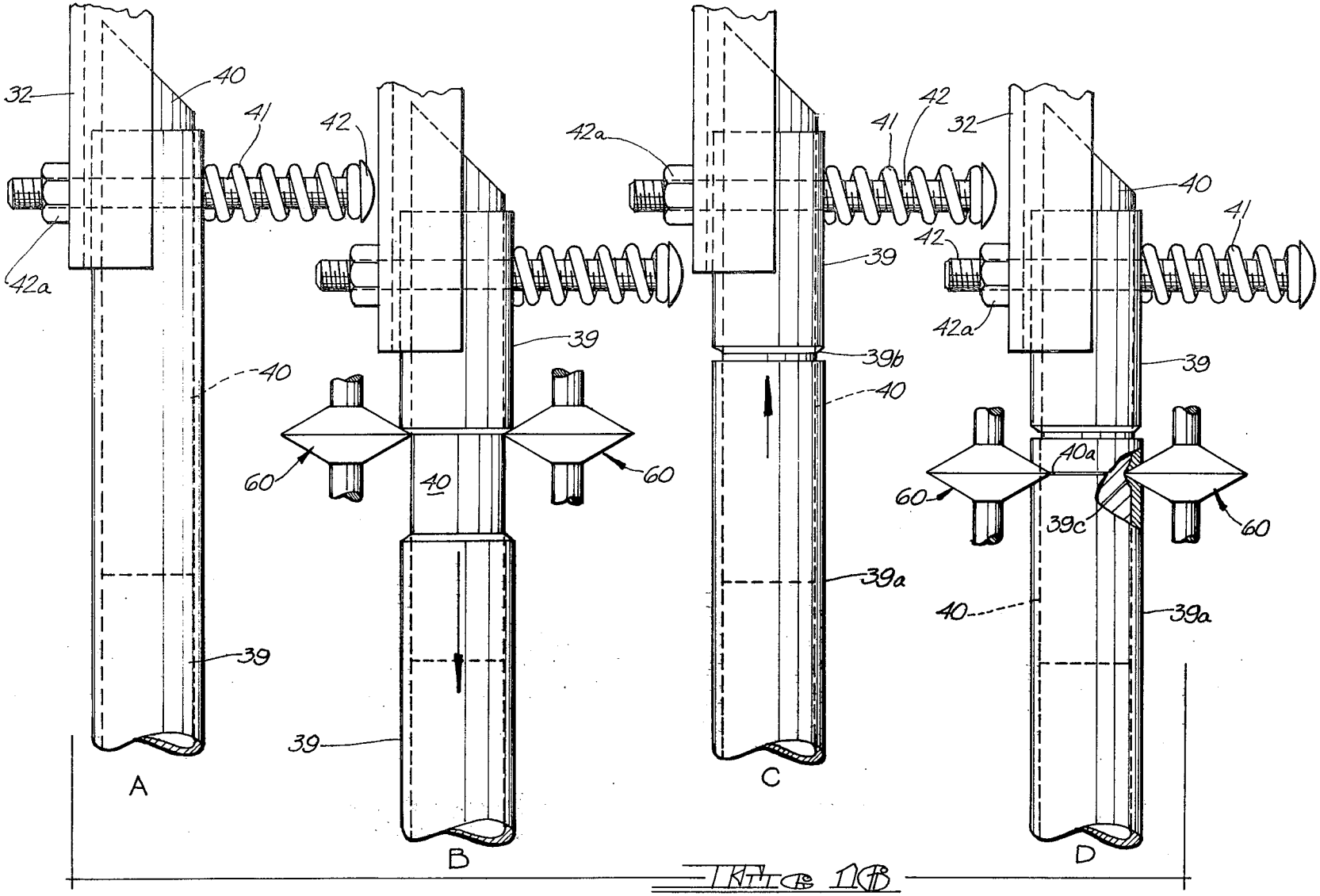

A tape receiving member is secured to the upper end of the leg receiving channel member 32. This member 43 is pivoted to a channel member 44 as indicated at 45. A spring 46 normally maintains the member 43 in a closed position within the channel member 44, see also FIG. 11. As is illustrated in FIG. 15, the arrangement of the members 43 and 44 is such that the member 43 may be moved against the force of the spring 46 to the extent which permits a flexible warning strip and the like 47 to be slipped between the members 43 and 44 whereafter the spring 46 will urge the member 43 to secure such strip 47 against the member 44. It will be observed that strip 47 is sandwiched smoothly and flatly between members 43 and 44. This orientation permits the warning indicia contained on strip 47 to remain clearly legible without bunching or wrinkling the strip, thus permitting reuse of the strips. In addition, individual warning strip sections can be held securely by the tape receiving member to form a smooth transition between the strip sections. Furthermore, maintaining a smooth surface along the warning strip minimizes wind resistance thereon which results in reduced stretching, tearing and slipping of the strip as well as minimized pulling forces which may tend to upset the barricade.

The barricade structure of FIGS. 1 through 6 is also indicated as being provided with shelf means 48 and socket means 49 by which a suitable lamp or light (not shown) may be secured to the member 31. A flag receiving member 50 is also provided.

In the arrangement of these FIGS. 1 through 6 it is to be understood that a pair of the panel receiving members 31 and associated structure including the support bracket 30 and legs 39 will be utilized, one at either end of a panel 34. In this manner panels 34 of any desired length may be used with a pair of the members 30, 31, 39. As perhaps best seen in FIG. 2 the panel 34 may slide between the front face of the member 31 and the rear flanges 31*a* and 31*b*; the socket member 49 is on a bracket 49*a* which is also spaced from the member 31 and the panel 34 may pass between it and the member 31 as well. The slot 33 is defined by the members 31 and 31*a* as well as by the upper and lower flanges 31*b* and bracket 49*a*.

The arrangement of FIGS. 1 through 6 with respect to the support bracket 30 has been found quite satisfactory. As will be described in FIG. 7 and related figures, the support bracket 30 may be affixed directly to a barricade panel 34, or its equivalent. In a preferred arrangement, however, whether the support bracket is to be a part of structures which can slidably receive a barricade panel 34, or whether it is part of a structure which is directly affixed to such a barricade panel, the support bracket 30 may be arranged in the manner illustrated in FIG. 19. In this arrangement the support bracket 30*a* is provided with the brace member 38*a* and with means 51 and 52 by means of which the support bracket 30*a* may be bolted to a pair of leg receiving channels and to either a panel receiving means, or to the panel itself, respectively.

Figure 3B:
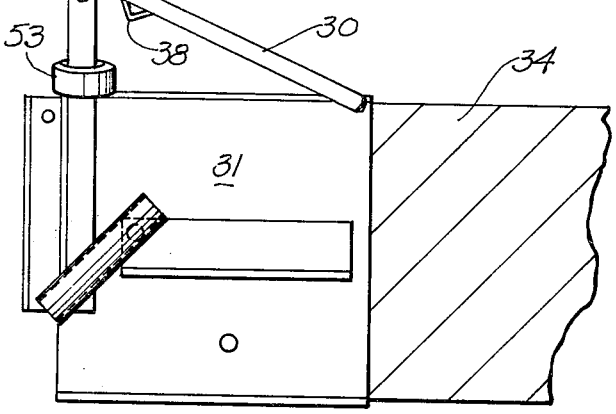
FIG. 3B is an exploded, partial front elevation showing the structure of FIG. 3A when upside down, the barricade panel being shown in place.

Returning again to FIG. 1 a lock ring 53 is shown. This ring has an internal diameter which permits it to slide about the leg receiving channel member 32 and the leg and plug 39, 40. When the locking ring 53 is in the position shown in FIG. 1 the legs 39, 40 are locked in position. When, however, the ring 53 is moved upwardly so as to become clear of the end of the plug 40, the leg 39, 40 may be moved against the action of the spring 41 to either a spread position or a folded position. One way to accomplish this is simply to turn the apparatus upside down as illustrated in FIG. 3B. In this and subsequent embodiments, the upper end of plug 40 is tapered to permit ring 53 to easily and automatically slide thereover without the need to manually move ring 53 over plug 40.

Figure 7:
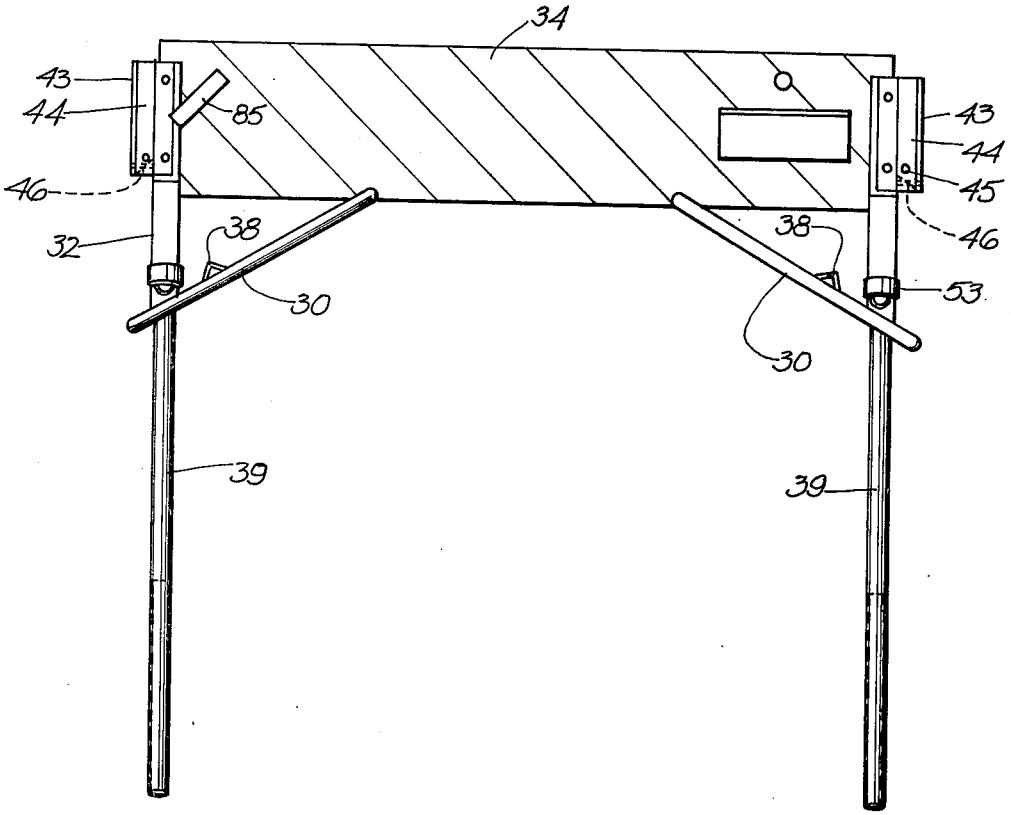
FIG. 7 is a front elevation of a modification of the invention which differs from that shown in FIGS. 1 through 6.

In the arrangement shown in FIG. 7 like numerals will be used to designate like parts. The principal difference between this arrangement and that of FIGS. 1 through 6 is that the support brackets 30 are affixed directly to a barricade panel 34; the leg receiving channel members 32 are also affixed to such panel 34 as by suitable bolts and the like. In the arrangement of FIG. 7 it will be observed that the barricade panel 34 is of a given length. Normally the legs 39 will be locked by the means 53 in the position shown in this FIGURE. If, however, when necessary to have the panel 34 span an opening greater than may be achieved when the legs 39 are in the FIG. 7 position, such legs, upon moving the locking ring 53 out of engagement with the plug 40, may be moved to the spread position illustrated in FIG. 9. In this position the legs 39, 40 will abut the brace member 38 of the support bracket 30 and the locking ring 53 will move by gravity to the position illustrated whereby to lend stability to the barricade structure even when the legs 39 are in the spread position. (The normal position of the legs 39 is illustrated in phantom in FIG. 9).

Figure 11:
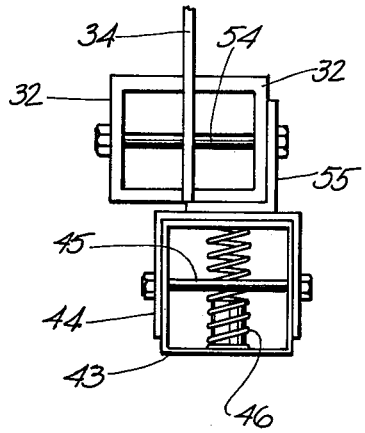
FIG. 11 is an enlarged plan view taken from above the structure depicted at the right hand side of FIG. 9.
Figure 10:
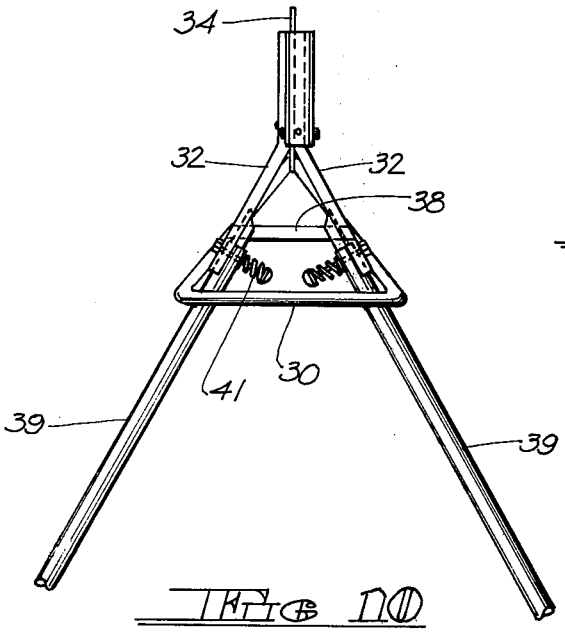
FIG. 10 is an end view of the FIG. 7 modification.

In the arrangement of FIGS. 7 through 15 the upper ends of the leg receiving channel members 32 are secured by bolts 54 and the like to the barricade panel 34. As best seen in FIG. 11 the channel 44 for the tape unit is secured to an intermediate flange 55 which is also secured to one of the channel members 32 and the bolt 54 may assist this as well.

Figure 9:
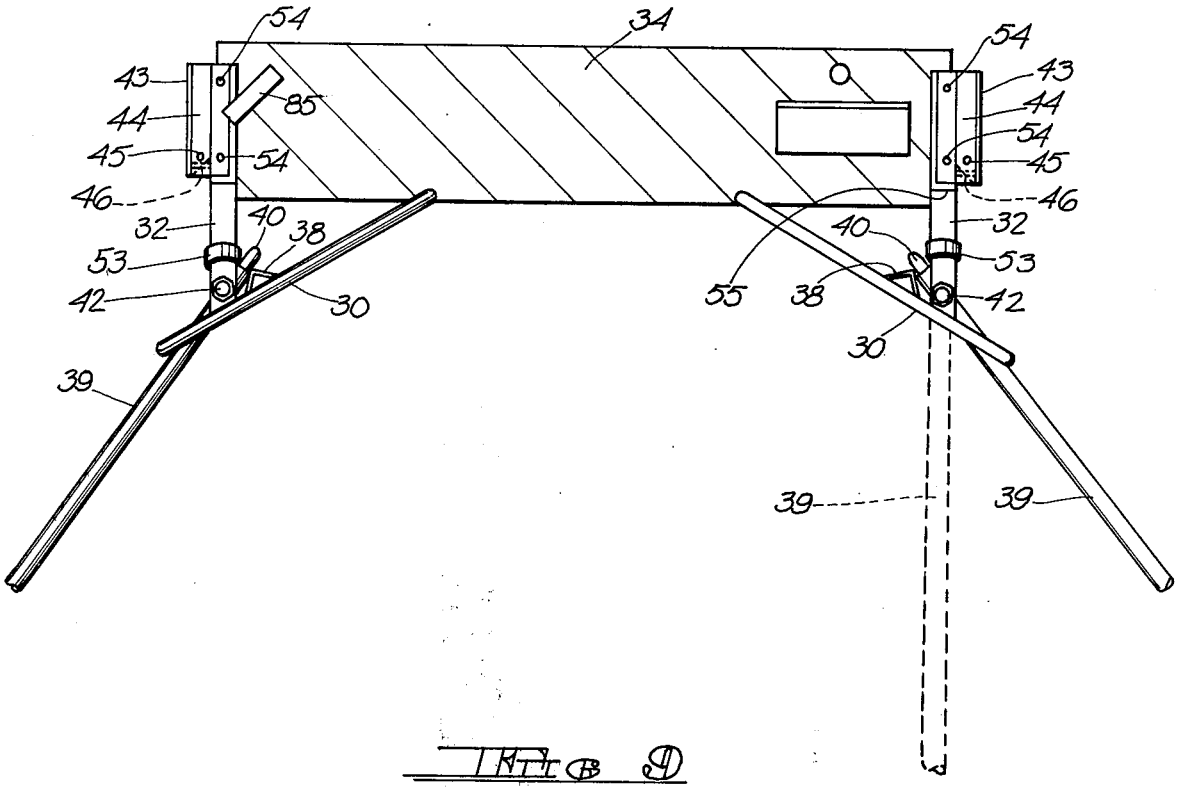
FIG. 9 is a front elevation of the modification of FIG. 7 showing the legs in their spread position, and including a phantom depiction of one set of legs in a vertical position.
Figure 14:
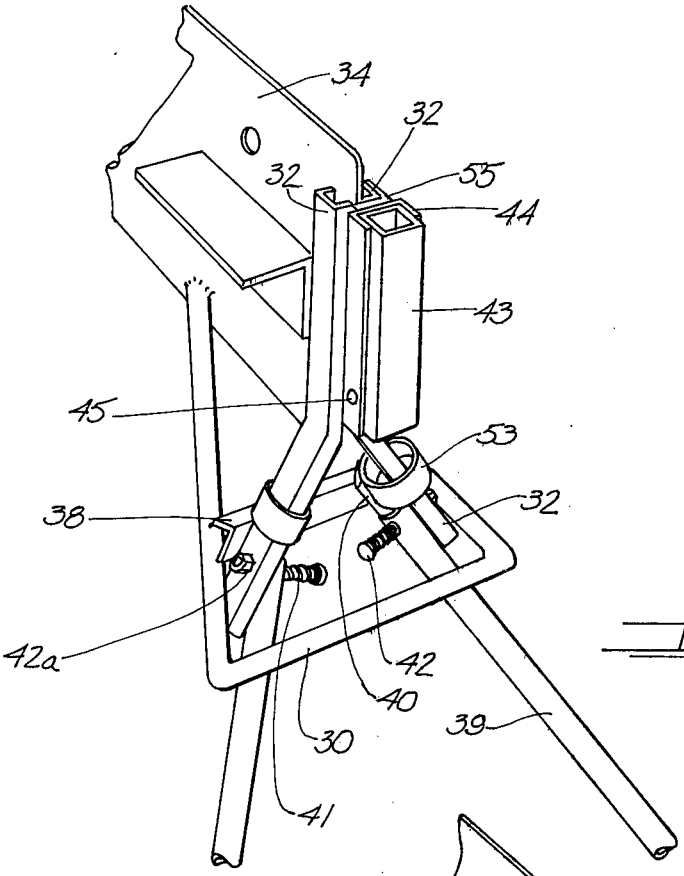
FIG. 14 is a fragmentary perspective view of the modification shown in the right hand side of FIG. 9.

FIGS. 14 and 15 further illustrate the arrangement of FIG. 9 wherein the legs 39 are in their spread position. In such position it will be understood that the locking rings 53 were first moved out of engagement with the plugs 40 whereafter the leg 39 and plug 40 were moved against the action of spring 41 until such point that the plug 40 abutted the brace member 38 of the support bracket 30; the locking rings 53 then moved by gravity to a position wherein they are now between the plug 40 and leg receiving channel 32. This ability to so spread the legs 39 permits a barricade panel 34 of a given length to be used in areas wherein that length, with fixed vertical legs, would not otherwise be usable.

Figure 8:
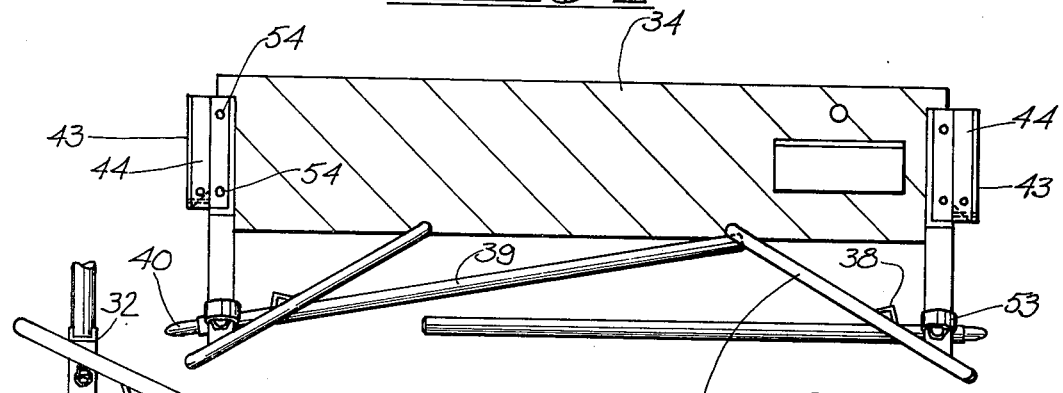
FIG. 8 is a front elevation of the modification of FIG. 7 with the legs shown in their folded position for carrying purposes.
Figure 12:
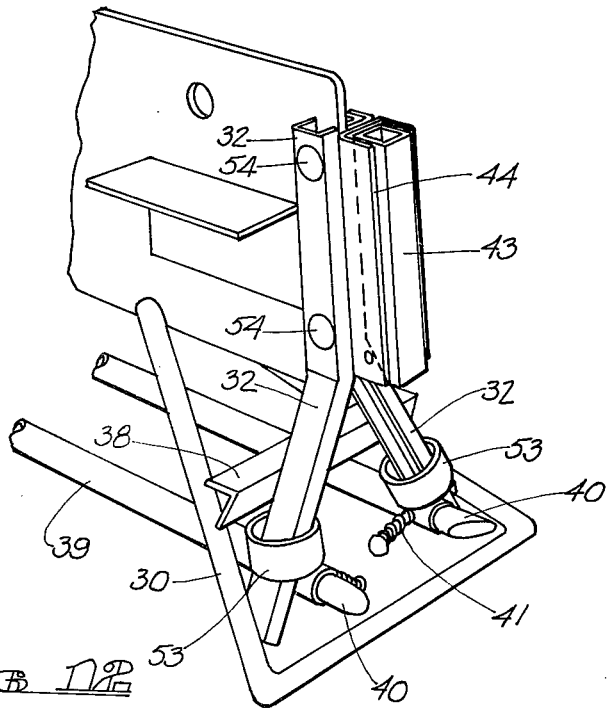
FIG. 12 is a perspective view of the modification of FIGS. 7 and 8 and showing the legs in their folded position.
Figure 11:
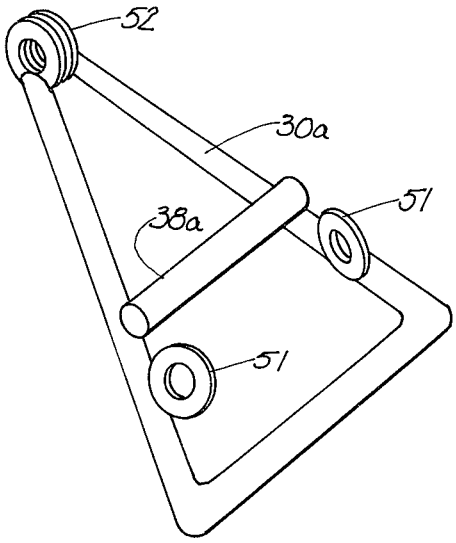

FIG. 8 illustrates how the legs 39 may be moved to a folded position such as may be desirable when transporting the barricade structure by vehicle and when it is manually carried from such vehicle to its point of use. Again, it will be understood that the locking rings 53 are first moved out of engagement with the plugs 40 of the legs 39, either by moving them by hand to such position or, as described in connection with FIG. 3B, by turning the structures upside down, whereafter the legs may then be moved to the FIG. 8 position. The legs 39 and support brackets 30 are so located on the barricade panel 34 that at least one of the legs may be moved to engage the end of the support bracket 30 at the point where such bracket is affixed to the panel 34. This enables one to carry the barricade structure simply by grasping the leg 39 which is so positioned with respect to the bracket 30. This carrying position is also illustrated in FIG. 12.

Figure 13:
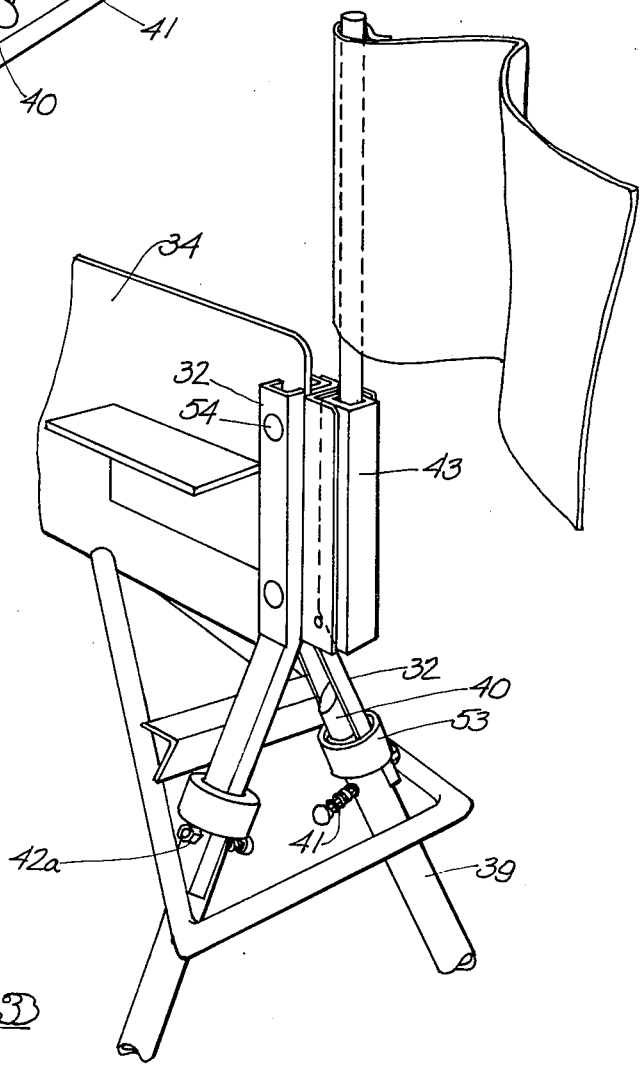
FIG. 13 is a fragmentary perspective view of the structure depicted at the right hand side of FIG. 7 and showing a warning flag in place.

With respect to the tape holding means 43 it should be understood that such means may be employed whether the legs are in the normal position of FIG. 7 or in the spread position of FIG. 9. In addition, the means 43 may also be used as a flag holding means as indicated in FIG. 13.

FIGS. 16A through 16D illustrate not only the construction of the leg 39 and plug 40 but also they illustrate an added advantage of such construction should it become necessary to repair a structure because of a damaged leg. FIG. 16A illustrates the leg 39 and plug 40 engaged within the leg receiving channel member 32 and held there in place by means of the bolt 42 and spring 41. If the lower end of a leg 39 becomes damaged it may be repaired without having to dismantle the means 42, 41 and 32. Rather, pipe cutters or the like, such as indicated at 60 in FIGS. 16B and 16D, may be employed to cut through the tubular member 39, above the damaged portion thereof, and in the region of the plug 40. When the leg 39 is so severed it may be removed from the plug 40 as indicated in FIG. 16B. Another tubular leg member **39*a* may then be slipped over the exposed lower end of the plug 40 as indicated in FIG. 16C. The upper end of the new leg member 39*a* may be jammed about the burr 39*b* of the old leg section 39, such burr being the result of the severing operation, whereby the new leg portion 39*a* will be secured to the remaining section of the original leg 39. A more positive manner, however, for securing the new leg section 39*a* to the plug 40 is illustrated in FIG. 16D. After the new leg member 39*a* has been moved to a position adjacent the remainder of the old leg section 39, the cutting members 60 are again employed. This time they are utilized to not only cut through the upper end of the new section 39*a* but also to bite into the plug 40. This results in an inturned burr 39*c* which engages within the groove 40*a* formed by the cutting means 60 thus positively securing the new section 39*a* to the plug 40**.

Figure 17:
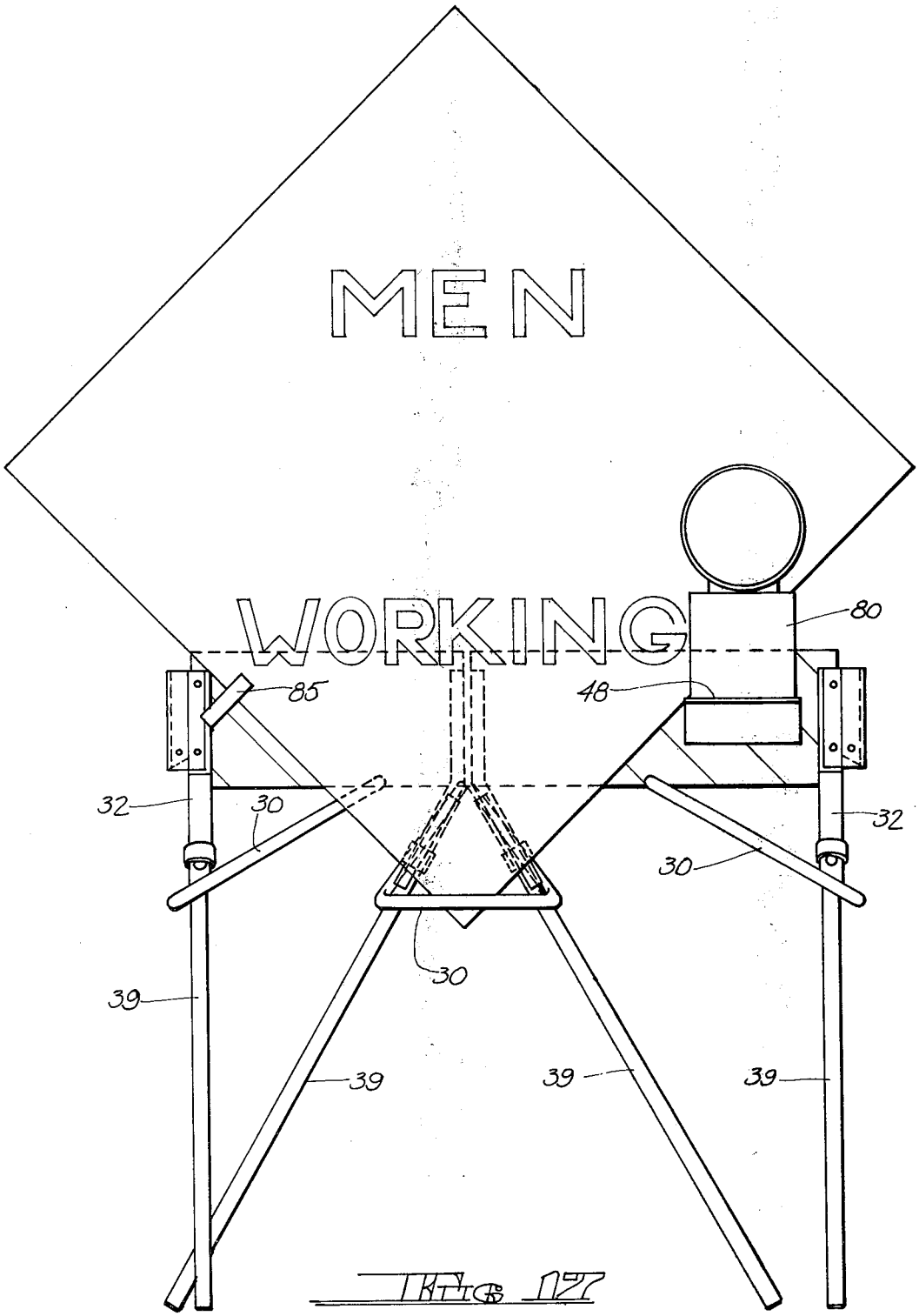
Figure 10B:
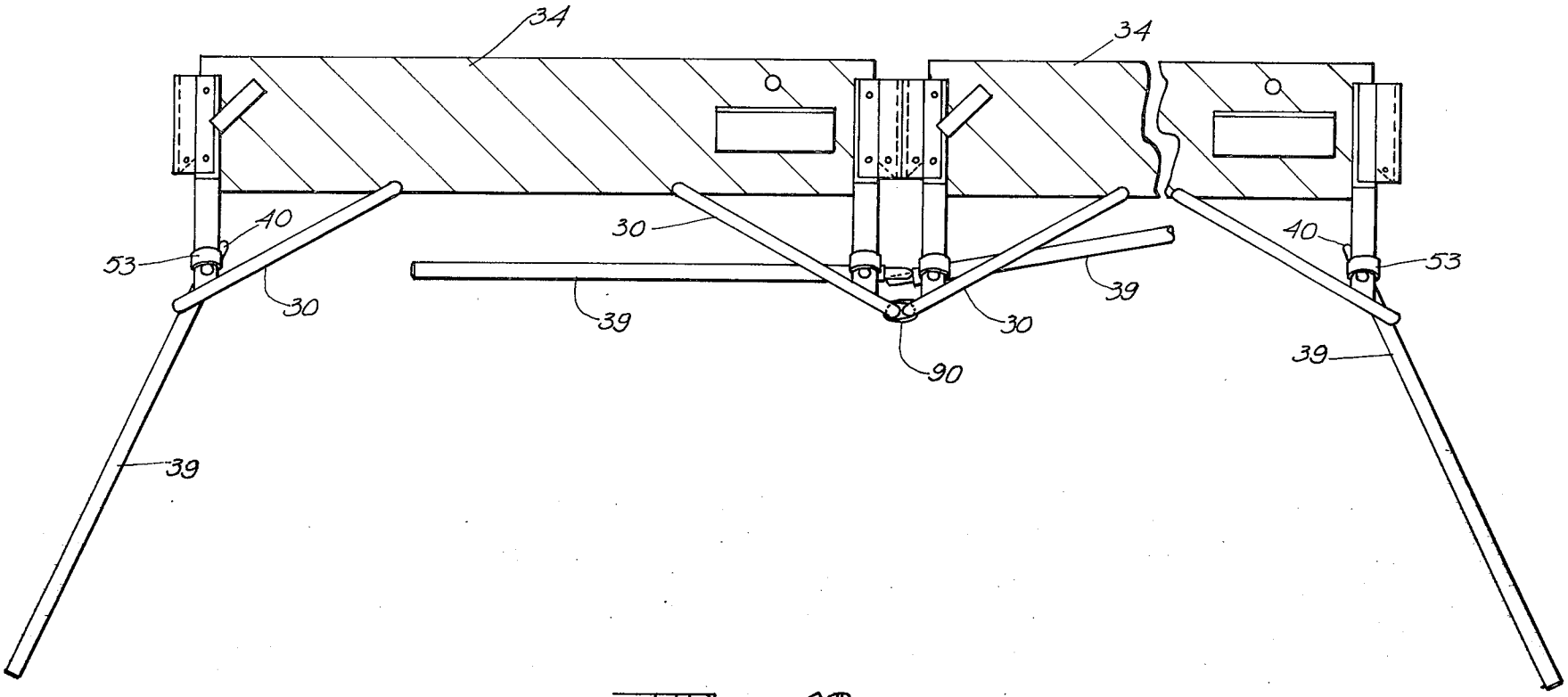

FIG. 17 illustrates the manner in which a pair of the barricade structures, such as those shown in FIG. 7 for example, may be utilized to support a sign in positive fashion even under severe weather conditions such as high winds and the like. In the arrangement of this FIGURE the sign 70 may be engaged between the support bracket 30' of one barricade structure and various of the means carried on the other of the barricade structures, such other means being, for example, the sign holder 85 and lamp or light 80 mounted on the bracket 48. It is the shape of the support bracket 30' that makes this arrangement possible.

Yet another advantage of the barricade structures of this invention is illustrated in FIG. 18 wherein two of the barricade structures are shown in end to end abutment. This arrangement permits cavities and the like of large extremes to be spanned by barricade panels 34. The maximum is obtained by first spreading the legs 39 of the two barricade standards to the spread position as illustrated and described in connection with FIG. 9. The other legs of the two barricade standards are then brought to the folded position illustrated in FIG. 8. The two barricade standards are then brought into the abutting aligned position of FIG. 18 and secured together simply by binding them with a suitable tape, wire and the like, such binding being about the abutting portions of the support brackets 30', one from each of the two barricade standards. Such binding is indicated at 90.

Again, it is the construction of the support bracket 30' which largely enables the barricade panels and standards to be used in the manner thus illustrated in this FIG. 18.

From the foregoing, therefore, it will be observed that the versatile all purpose barricade structures of this invention include the novel support brackets 30, 30'(FIGS. 15, 17 and 18) and 30*a* (FIG. 19) along with the leg and plug arrangement 39, 40, and including the locking means 53 which act in conjunction not only with the plugs 40 and channel members 32 but also with the support bracket brace member 38, depending on the various positions to which the legs 39 are moved. These structures include the tape unit for affixing a flexible tape thereto quickly and in positive manner. These tapes, secured to a pair of standards or more by the units 43, 44 make it possible to quickly and conveniently "rope off" large areas. These structures also enable the leg members and associated support bracket 30 to be either affixed directly to the respective ends of a barricade panel 34 or to be affixed to a panel receiving means 31 as illustrated, for example, in FIGS. 7 and 1 respectively.

It will be apparent to those skilled in the art that other advantages may stem from this invention. Note, for example, that the various barricade parts are so arranged that it would be a simple matter to move the structure of FIG. 8 through 90° whereby the panel 34 would be in an upright position, the structure resting on the members 43 and 30. A flag or warning means may then be affixed to the upper end of the structure, thus enabling the warning means, whether it be a flag or light and the like, to be prominently displayed. And as also illustrated in this FIG. 8, the folded position of the leg 39 into engagement with the support bracket 30 makes it very easy for one to carry the structure from place to place.

It will also be understood by those skilled in the art that modifications may be made in the various barricade structures of this invention without departing from the scope and spirit thereof. And while the invention has been described in terms of certain particular structures and arrangements thereof, the invention is not to be restricted to such certain structures and arrangements except insofar as they are specifically set forth in the subjoined claims.

Having thus described the invention, what is claimed as new and what is desired to be protected by Letters Patent is:

1. A support structure comprising: a first elongated member adapted to be horizontally disposed; a first pair of legs secured adjacent an end of said first elongated member and extending downwardly therefrom; and a first triangular brace member comprised of a base member and two struts terminating in an apex, said apex being attached to said first elongated member inwardly from said end, said two struts extending downwardly and outwardly away from said end of said first elongated member and away from said attached apex, each leg of said first pair of legs being attached inside said first triangular brace member at a respective point removed from said apex, and extending beyond said base member.

2. The support structure of claim 1 including a tape clamp whereby to secure flexible warning tape and the like thereto.

3. The support structure of claim 1 in which the said legs diverge from said first elongated member.

4. The support structure of claim 1 including a first bar extending across said first triangular brace member between said apex and said respective points at which said legs are attached to said first triangular brace member and parallel to said base member.

5. The support structure of claim 1 in which each leg of said first pair of legs is comprised of a channel element affixed to said first elongated member and of a leg element received in and attached to said channel element.

6. The support structure of claim 5 in which each of said leg elements is comprised of a tubular member having at least one end hollow and including a solid plug in said hollow, said plug being disposed toward said first elongated member.

7. The support structure of claim 6 in which each of said tubular members is pivotally attached to its respective said channel element, said support structure further including spring biased means to urge said tubular member to a seated position within its respective said channel element.

8. The support structure of claim 7 including movable locking means to lock a said tubular member within its respective said channel element.

9. The support structure of claim 8 in which said movable locking means includes a ring element freely slidable about said tubular member and said channel element.

10. The support structure of claim 5 in which the attachment of a said leg to said first triangular brace member is by virtue of an attachment between the respective channel element for said leg and said first triangular brace member.

11. The support structure of claim 5 including a tape clamp comprising a first member secured to said channel element and a spring biased second member secured to said first member, whereby flexible tape may be secured between said first member and said second member.

12. An arrangement comprised of a pair of the said support structures of claim 1, and means to secure said pair in face-to-face relationship.

13. An arrangement comprised of a pair of the said support structures of claim 1, the said first elongated member comprising a single barricade panel to which each pair of legs is secured in like manner.

14. The support structure of claim 1 in which said first elongated member is provided with first means to receive a barricade panel, said barricade panel being located in said first means.

15. The support structure of claim 14 including a second elongated member adapted to be horizontally disposed, said second elongated member being provided with second means to receive a barricade panel; a second pair of legs secured adjacent an end of said second elongated member and extending downwardly therefrom; and a second triangular brace member comprised of a base member and two struts terminating in an apex attached to said second elongated member inwardly from said last mentioned end, said last mentioned two struts extending downwardly and outwardly away from said last mentioned end of said second elongated member and away from said last mentioned apex, each leg of said second pair of legs being attached within said second triangular brace member at a respective point removed from said last mentioned apex and extending beyond said last mentioned base member, said barricade panel being received in both said first means and said second means.

16. The support structure of claim 1 in which said first elongated member comprises a barricade panel, said end of said first elongated member being an end of said barricade panel.

17. The support structure of claim 16 in which said barricade panel is provided with a second pair of legs secured thereto adjacent an opposite end of said barricade panel and extending downwardly therefrom; and a second triangular brace member comprised of a base member and two struts terminating in an apex attached to said barricade panel inwardly from said opposite end, said last mentioned two struts extending downwardly and outwardly away from said opposite end of said barricade panel and away from said last mentioned apex, each leg of said second pair of legs being attached within said second triangular brace member at a respective point removed from said last mentioned apex and extending beyond said last mentioned base member.

18. An arrangement comprised of a pair of the said support structures of claim 1, each of said elongated members being provided with means to receive a barricade panel, said barricade panel having each end thereof received in a respective one of said means.

19. A barricade standard comprising a channel member; a leg received in said channel member, said leg comprising a tubular member having a solid plug in one end thereof, which plug protrudes from said tubular member; pivot means pivotally joining said tubular member and said plug to said channel member; a triangular support bracket; a panel receiving element; said triangular support bracket being affixed to said channel member and to said panel receiving element; said channel member also being affixed to said panel receiving element; and movable lock means on said channel member, said lock means having a locked position for holding said tubular member in said channel member and an unlocked position for permitting said tubular member to be moved out of said channel member.

20. The standard of claim 19 in which said tubular member is slidable on said plug so that when said tubular member is severed at a region remote from said pivot means, that portion of the severed tubular member which is free of said pivot means may be removed from said plug and a new tubular member put on said plug, and means to secure said new tubular member to said plug, said last mentioned means comprising a burr on said new tubular member, which burr is engaged within a groove provided in said plug.

21. The standard of claim 19 including weight elements located within said tubular member whereby to do away with the need to use sand bags and the like to hold the standard in place.

22. The standard of claim 19 including a clamp for securing flexible tape thereto.

23. The standard of claim 19 in which an apex of said triangular support bracket is affixed to said panel receiving element; and there being two of said channel members, each of said channel members being affixed to said triangular support bracket at points removed from said apex; and a brace member extending across said triangular support bracket parallel to an imaginary straight line connecting said points.

24. A barricade standard comprising a channel member; a leg received in said channel member; said leg comprising a tubular member having a solid plug in one end thereof, which plug protrudes from said tubular member; pivot means pivotally joining said tubular member and said plug to said channel member; a triangular support bracket; a barricade panel element; said triangular support bracket being affixed to said channel member and to said barricade panel element; said channel member also being affixed to said barricade panel element; a brace member on said triangular support bracket, said brace member normally being spaced from said plug; and movable lock means on said channel member, said lock means having a locked position for holding said tubular member in said channel member and an unlocked position for permitting said tubular member to be moved out of said channel member; said brace member being located on said triangular bracket member so as to be engaged by said plug when said tubular member is moved out of said channel member to a spread position for said leg when said movable lock means is in its unlocked position.

25. The standard of claim 24 including a clamp for securing flexible tape thereto.

26. The standard of claim 24 in which an apex of said support bracket is affixed to said barricade panel element; and there being two of said channel members, each of said channel members being affixed to said triangular support bracket at points removed from said apex; said brace member extending across said triangular support bracket parallel to an imaginary straight line connecting said points.

27. A triangular brace member for use in securing a pair of legs to an elongated member adapted to be horizontally disposed, said triangular brace member being comprised of a base member and two struts terminating in an apex, said apex being provided with first means by which said triangular brace member may be fastened to such an elongated member, each of said struts extending from said apex to a respective end of said base member, and a pair of second means integral on said triangular brace member by virtue of which said triangular brace member may be fastened to each leg of the pair of legs such that said legs extend within said triangular brace member beyond said base member.

28. The triangular brace member of claim 27 in which one of said means is located on one of said struts and the other of said second means is located on the other of said struts.

29. The triangular brace member of claim 27 including a cross bar fastened to said struts and disposed between said apex and said base member parallel to said base member.

30. A barricade standard comprising a pair of spaced support structures and a substantially horizontal elongated barricade panel extending between and supported by said support structures, each of said support structures having a pair of legs secured adjacent an end of said barricade panel and extending downwardly therefrom and a triangular brace member comprised of a base member and two struts terminating in an apex, said apex being attached to said barricades panel inwardly from said end, said two struts extending downwardly and outwardly away from said end of said barricade panel and away from said attached apex, each leg of said pair of legs being attached within said triangular brace member at a respective point removed from said apex and extending beyond said base member.

31. A barricade standard comprising at least one vertically disposed support structure supporting an elongated barricade panel at one end, said support structure having a pair of legs extending downwardly from said supported end of said barricade panel and a triangular brace member comprised of a base member and two struts terminating in an apex, said apex being attached to said barricade panel inwardly from said supported end of said barricade panel, said two struts extending downwardly and outwardly away from said supported end of said barricade panel and away from said attached apex, each leg of said pair of legs being attached to said triangular brace member at a respective point removed from said apex and extending within said triangular brace member beyond said base member, each leg including a channel member secured to said barricade panel and a leg section received in said channel member, said leg section comprising a tubular member having a solid plug protruding from one end thereof, said leg further including pivot means pivotally joining said tubular member and said plug to said channel members and lock means having a locked position for holding said tubular member in said channel and an unlocked position for permitting said tubular member to be moved out of said channel member, said lock means comprising a ring element freely slidable about said tubular member and said channel element, said ring element operating to automatically lock said leg in supporting position when said support structure is vertically disposed.

* * * * *

UNITED STATES PATENT AND TRADEMARK OFFICE

CERTIFICATE OF CORRECTION

PATENT NO. : 4,183,317

DATED : January 15, 1980

INVENTOR(S) : George E. Follick

It is certified that error appears in the above-identified patent and that said Letters Patent are hereby corrected as shown below:

In the specification, column 2, line 1 cancel "up" and insert --by--.

In the claims, claim 28, line 2, before the word "means" insert --second--.

In the drawings: FIGURE 15 should be considered as having the reference numeral "30'" applied to the triangular brace member there shown; FIGURE 17 should be considered as having the "prime" mark applied to the triangular brace member 30 shown in the center of that figure; and FIGURE 18 should be considered as having the addition of the "prime" mark to each of the three reference numerals 30, and the addition of the reference numeral "30'" to the triangular brace member shown at the right hand side of that figure.

Signed and Sealed this

*Twenty-fourth* Day of *June 1980*

[SEAL]

*Attest:*

SIDNEY A. DIAMOND

*Attesting Officer*

*Commissioner of Patents and Trademarks*